US005192153A

United States Patent [19]

Gueret

[11] Patent Number: 5,192,153

[45] Date of Patent: Mar. 9, 1993

[54] AGITATOR ASSEMBLY FOR A PASTY COSMETIC PRODUCT

[75] Inventor: Jean-Louis H. Gueret, Paris, France

[73] Assignee: L'Oreal, Paris, France

[21] Appl. No.: 713,058

[22] Filed: Jun. 10, 1991

[30] Foreign Application Priority Data

Jun. 27, 1990 [FR] France ..... 90 08083

[51] Int. Cl.[5] ..... A45D 40/00; A45D 40; A45D 18

[52] U.S. Cl. ..... 401/4; 401/129

[58] Field of Search ..... 401/4, 129

[56] References Cited

U.S. PATENT DOCUMENTS

| | | | |
|---|---|---|---|
| 2,631,826 | 3/1953 | Wolf . | |
| 2,793,012 | 5/1957 | Wolf . | |
| 2,990,834 | 7/1961 | Amen . | |
| 3,085,281 | 4/1963 | Massman . | |
| 3,115,664 | 12/1963 | Del Ponte | 401/4 |
| 3,738,760 | 6/1973 | Madeira | 401/4 |
| 4,290,706 | 9/1981 | Wandl | 401/4 |
| 4,960,339 | 10/1990 | Iizuka et al. | 401/4 X |
| 4,984,918 | 1/1991 | Iizuka et al. | 401/4 |

FOREIGN PATENT DOCUMENTS

| | | | |
|---|---|---|---|
| 0325766 | 8/1989 | European Pat. Off. . | |
| 0350535 | 1/1990 | European Pat. Off. . | |
| 2127748 | 12/1972 | Fed. Rep. of Germany | 401/4 |
| 1318199 | 1/1963 | France . | |

*Primary Examiner*—Steven A. Bratlie
*Attorney, Agent, or Firm*—Cushman, Darby & Cushman

[57] ABSTRACT

An applicator assembly includes a container for a pasty cosmetic product, the container having a neck, a cap provided with threads for attachment to the neck, the cap carries a rod at the end of which there is provided an applicator element; container has a rotatably mounted stirring element and a driver for rotating the stirring element as the rod to which the stirring element is releasibly connected is withdrawn or inserted into the container; the stirring element has lateral extensions for stirring the product in the container.

8 Claims, 3 Drawing Sheets

AGITATOR ASSEMBLY FOR A PASTY COSMETIC PRODUCT

FIELD OF THE INVENTION

The invention relates to an applicator assembly of the type comprising, firstly, a container containing a pasty cosmetic product, especially mascara, in particular consisting of a heterogeneous or thixotropic composition, this container being provided with a bottom, a lateral wall and, at the end opposite the bottom, a neck generally provided with a drainage lip, secondly, a cap provided with fixing means to the neck and carrying a rod at the end of which there is provided an applicator element adapted to be located in the vicinity of the bottom of the container when the cap is fixed to this container, thirdly, a stirring element rotatably mounted in the container and, finally, means for driving this stirring element in rotation, so that it is possible, in particular, to actuate the said stirring element at the time of use of the applicator assembly.

DESCRIPTION OF THE PRIOR ART

EP-A-0 325 766 describes an applicator assembly of this type, in which the stirring element extends over the greater part of the length of the container, so that a relatively large force has to be applied in order to rotate this stirring element. Moreover, the action of a stirring element of this kind on the product contained in the container demands improvement, in particular in order to promote mixing of the components of the container and, if appropriate, to break the thixotropy.

U.S. Pat. No. 2,990,834 describes a mascara applicator assembly, in which a closure element is provided for the neck to be applied to the passage of the neck when the cap is removed from the container. The closure element is pushed by a spring against the opening of the neck when the applicator element is withdrawn from the container, while this closure element is pushed towards the bottom of the container again when the applicator element is reinserted into the container, the cap being fixed to this container. The said closure element consists of a disc and has reduced radial dimensions, so that the contour of this element remains at a distance from the inner surface of the container. This closure element cannot display efficiency comparable to that of a rotary stirring element.

SUMMARY OF THE INVENTION

The object of the invention is above all to provide an applicator assembly of the type defined hereinbefore which, especially at the time of use of the product, allows for more efficient stirring in the interior of the container, in particular to achieve improved homogenisation of the product and to break its thixotropy, without the user having to apply considerable force in order to obtain this result.

According to the invention, an applicator assembly of the type defined hereinbefore is characterised in that the stirring element has reduced dimensions in the longitudinal direction of the container, and that it comprises extensions extending radially from the vicinity of the rod to the vicinity of the lateral wall of the container, these extensions defining radial passages between them, while control means are provided in order to impart to this stirring element, in addition to the movement of rotation about the axis of the rod, a simultaneous movement of translation up the container and/or vice versa.

The overall dimensions or overall length of the stirring element in a direction parallel to the axis of the container is/are preferably less than quarter of the length of the container.

The stirring element advantageously consists of a screw member and the extensions are formed by the blades of the screw.

According to another possibility, the stirring element consists of a sprocket wheel, the extensions being formed by radially extending ribs or rods.

According to a first embodiment, the stirring element comprises at least two opposing projections directed radially towards the exterior, while mating helical grooves are provided in the inner lateral wall of the container to cooperate with the said projections, the said stirring element being mounted to rotate freely on the rod, translational drive means being provided in order to effect the displacement in translation of the stirring element in the interior of the container, this translation being accompanied by rotation as a result of the cooperation of the projections and the helical grooves.

The translational drive means may consist of a translational connection between the stirring element and the rod, so that when the cap is removed from the container, the rod moves the stirring element from the bottom of the container towards the neck, the means for connecting the rod and the stirring element allowing for the release of the stirring element when it arrives at the neck, and the connection being re-established when the applicator element is reinserted into the container.

The translational connection of the stirring element, especially the screw member, and the rod may be ensured by lugs provided on a boss of the stirring element and adapted to grip the rod, in particular at an elastic sleeve which, when it is disengaged from the lug, has an outer diameter at least equal to that of the rod, thereby allowing this sleeve to be drained when the rod is withdrawn.

According to a variant, a sleeve is provided in the interior of the container against the lateral wall of this container, this sleeve being rotatably mounted in the said container and being connected to a wheel situated in the lower part of the container, the sleeve comprising rectilinear sliding surfaces parallel to the axis of the container adapted to be traversed by the projections of the stirring element, these projections being engaged via their ends in the said helical grooves, so that by virtue of the rotation of the wheel, the stirring element can be raised and lowered in the container with simultaneous rotation, the rod being engaged freely in rotation and in translation in the centre of the stirring element.

According to another embodiment, the applicator assembly comprises an elastic spiral member generally comprising at least two ribs, the base of which is situated in the vicinity of the bottom of the container and is fixed to this bottom, and the opposite end of which is integral with the stirring element which is traversed freely in rotation by the rod of the applicator element, while being connected in translation to this rod, the arrangement being such that when the applicator assembly is at rest, the cap being in place on the container, the stirring element is engaged and held in translation on the rod just above the applicator element at the bottom of the container, while, when the cap is removed, the withdrawal of the rod drives the stirring element in translation and allows for longitudinal expansion of the spiral member, simultaneously resulting in rotation of the stirring element which remains in the container when the applicator element is withdrawn therefrom, this applicator element passing through a central opening in the applicator element in order to be engaged once again in this opening and to be connected in translation to the rod when it is reinserted into the container.

The spiral member and the stirring element are advantageously formed in one single piece produced from plastic, in particular by moulding.

BRIEF DESCRIPTION OF THE DRAWINGS

In addition to the arrangements described hereinabove, the invention consists of a number of other features which will be described in more detail hereinafter by way of several nonlimiting embodiments described with reference to the accompanying drawings, in which.

DETAILED DESCRIPTION OF THE INVENTION

Figure 1:
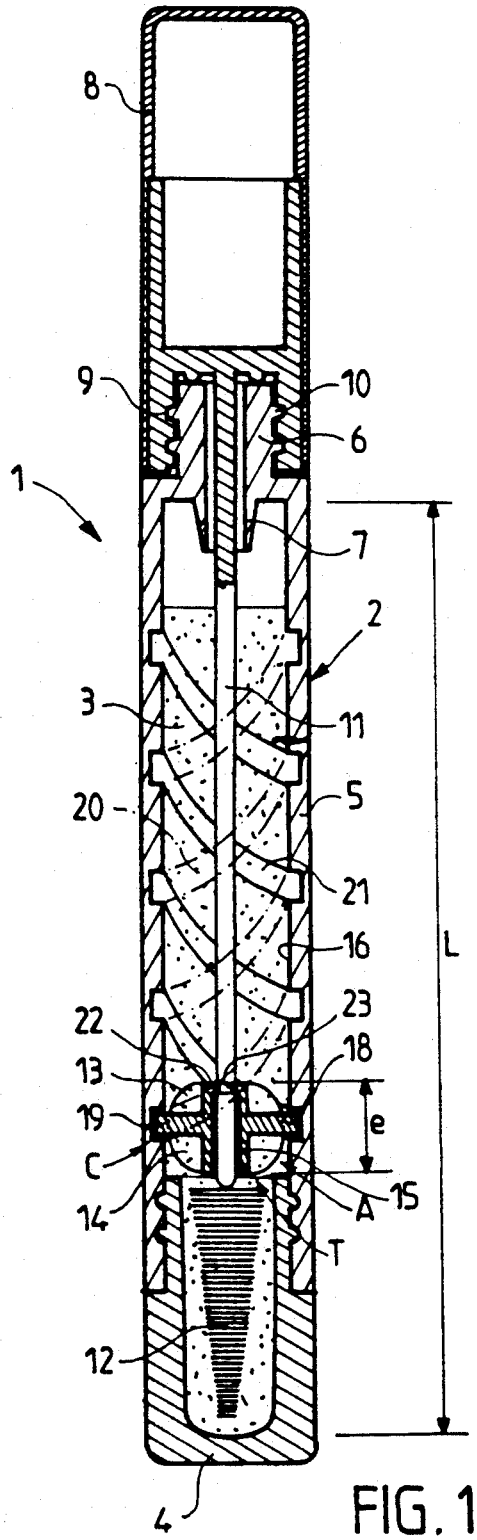
FIG. 1 is an axial vertical section of an applicator assembly according to the invention, the cap being fixed to the neck of the container.

Referring to FIG. 1, it shows an applicator assembly 1 comprising a container 2 containing a pasty cosmetic product 3, especially mascara, in particular consisting of a heterogeneous or thixotropic composition. The container 2 is in the shape of a cylinder generated by rotation and is provided with a bottom 4, e.g. snapped on to the end of the cylinder. This bottom 4 is locked in translation and in rotation relative to the cylinder of the container 2. This container 2 moreover comprises a lateral cylindrical wall 5 and, at the end of the wall 5 opposite the bottom 4, a portion of smaller diameter forming a neck 6. In the interior of the container 2, the inlet to the neck 6 is provided with a drainage lip 7.

A cap 8 provided with fixing means consisting of an internal thread 9 may be fixed to the neck 6 by cooperation of this thread with an external thread 10 provided around the neck 6.

The cap 8 carries a rod 11 adapted to penetrate axially into the container 2.

An applicator element 12, consisting, inter alia, of a brush, is fixed to the end of the rod 11 so as to be located in the vicinity of the bottom 4 in the interior of the container 2 when the cap 8 is fixed to this container, as illustrated in FIG. 1.

A stirring element A consisting of a screw member 13 is rotatably mounted in the interior of the container 2 around the rod 11. In the closed position of the applicator assembly shown in FIG. 1, the screw 13 is located at the bottom 4 and is traversed freely in rotation by the end of the rod 11. The screw 13 is just above the upper end of the brush 12.

The screw 13 has reduced dimensions e in the longitudinal direction of the container 2, this dimension e preferably being less than ¼ of the internal length L of the container 2 ($e<L/4$).

The screw 13 comprises extensions formed by blades 14 extending radially from the vicinity of the rod 11 virtually from a boss 15 of the screw surrounding the rod to the inner lateral wall 16 of the container 2.

Figure 2:
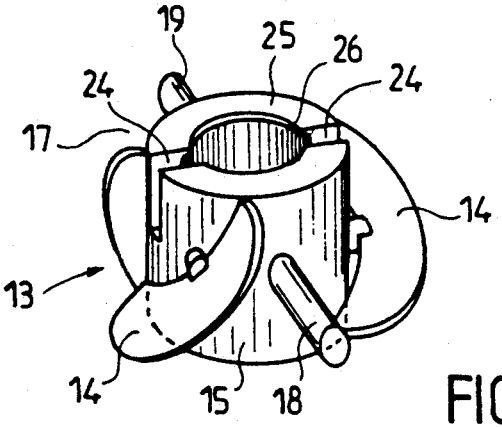
FIG. 2 is a perspective view of the stirring element produced in the form of a screw member.

As can be seen in FIG. 2, the blades 14 define radial passages 17 between them.

Control means C are provided in order to impart to the screw 13, in addition to a movement of rotation about the axis of the rod 11, a simultaneous movement of translation up the container 2.

The screw 13 comprises two opposing projections 18, 19 directed radially towards the exterior. The control means C comprise two helical grooves 20, 21 offset angularly by 180° provided in the inner lateral wall 16 of the container and adapted to cooperate with the projections 18, 19.

It should be noted that the helical grooves 20, 21 may have a variable pitch, this pitch being relatively large towards the lower and upper ends of the grooves 20, 21, while the pitch is relatively small in the centre region of the helical grooves.

Translational connection means T of the snapping type are provided between the boss 15 of the screw 13 and the rod 11. These means T may comprise at the boss of the screw elastic lugs 22 distributed in a ring and adapted to enter into snap engagement with an annular throat 23 of the rod 11 so that the screw is held, in a freely rotatable manner, slightly above the brush 12 without obstructing this brush during its rotation.

The means T form means for controlling the translational movement of the screw 13.

This being the case, the operation of the applicator assembly 1 of FIG. 1 is as follows.

In the closed position of the assembly, the screw 13 is located in the position illustrated in the drawings in the vicinity of the bottom 4, the projections 18, 19 resting against the lower ends of the helical grooves 20, 21. At the time of use, when the lid 8 and the rod 11 are removed from the container 2, the rod 11 moves the screw 13 in translation. The cooperation of the helical grooves 20, 21 and the projections 18, 19 results in a movement of rotation of the screw 13 about the rod 11, while simultaneously the screw 13 is displaced upwards in translation.

This results in particularly efficient stirring and mixing of the product 3. The force applied to the rod 11 is not too great as stirring of the product is effected by successive layers of reduced thickness corresponding to the axial dimensions e of the screw 13.

When the projections 18, 19 reach the upper ends of the grooves 20, 21, the movements of rotation and translation of the screw 13 are blocked. By continuing to pull the lid 8 and the rod 11, the user will open the connection means T and release the screw 13 relative to the rod 11. The brush 12 passes through the boss 15 of the screw 13 before passing through the drainage lip 7.

When the brush 12 and the rod 11 are reinserted into the container 2, the screw 13 is pushed towards the bottom 4 again and once the lid 8 has been screwed on to the neck 6, the connection means T for the screw 13 and the rod 11 enter into snap engagement once again.

FIG. 2 shows a perspective view of a variant embodiment of the screw 13. The blades 14, four in number, are distributed in a regular manner around the boss 15 with which they are made integral by means of rod-shaped elements. The blades 14 are inclined relative to the plane orthogonal to the axis of the boss 15. The projections 18 and 19 are themselves integral with the boss 15 and are situated angularly between two blades. Two diametrically opposing notches 24 are provided at one end of the boss 15 so as to define two substantially semicircular zones 25 having a certain radial elasticity and provided with a rim 26 adapted to come into snap engagement with the annular throat 23 of the rod 11, while allowing for free rotation of the screw 13 relative to the rod 11.

Figure 3:
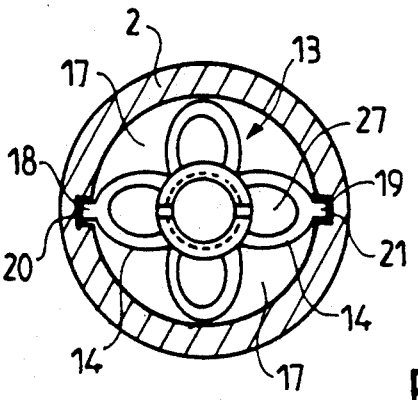
FIG. 3 is a plan view of a variant embodiment of the stirring element in the form of a screw member.

FIG. 3 shows a plan view of another embodiment of the screw 13 produced with blades 14 comprising recesses 27. According to the variant of FIG. 3, the projections 18, 19 are provided at the ends of two diametrically opposing blades 14.

The screw 13 comprises a boss which is always situated above the brush 12. It would be possible to provide the screw 13 at the level of the brush 12, the blades 14 then being situated around this brush.

Figure 4:
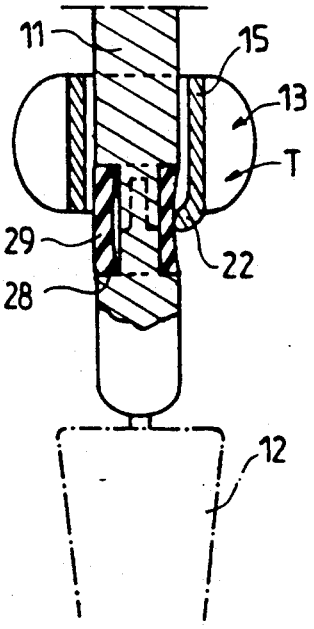
FIG. 4 is a detail showing, on a larger scale, the production of the translational connection between the screw and the rod carrying the applicator element.

FIG. 4 shows a variant embodiment of the translational connection means T for the screw 13 and the rod 11. The boss 15 again comprises lugs or tongues 22 having curved ends and a certain elasticity in the radial direction. The rod 11 comprises an annular housing 28 in which there is mounted a deformable elastic sleeve 29 which, when it is disengaged from the lug 22, as can be seen on the left hand side of FIG. 4, has a diameter at least equal to that of the rod 11. In this manner, when it is disengaged from the lugs 22 at the top of the container 2, the outer surface of the sleeve 29 may be drained efficiently via the lip 7 as its diameter is at least equal to that of the rod 11.

As can be seen in FIG. 4 (left hand portion), the inner surface of the sleeve at rest is concave so that its centre portion does not rest against the part of the rod radially defining the bottom of the housing 28.

Figure 5:
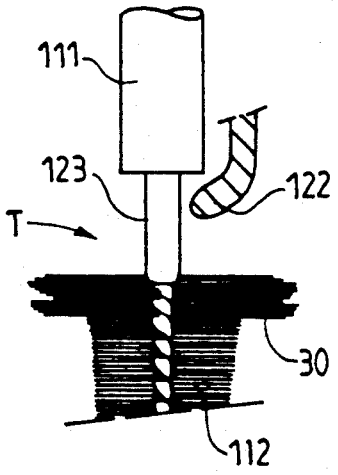
FIG. 5 is a detail of a variant of the connection between the screw and the rod.

Referring to FIG. 5, it shows another embodiment of the connection means T for the screw and the rod. Those elements of FIG. 5 identical or similar to the elements already described with reference to the preceding figures have been designated by reference numerals equal to the sum of the number 100 and the reference numeral used in the preceding figures.

The connection means T comprise on the side of the screw elastic tongues 122 adapted to engage in an annular throat 123 formed by a narrowed portion of the rod 111 just above the brush 112. A shoulder 30 is formed below the lower ends of the tongues 122 by the bristles of the brush 112 cut to draw the screw upwards when the rod 111 is extracted from the container.

Figure 6:
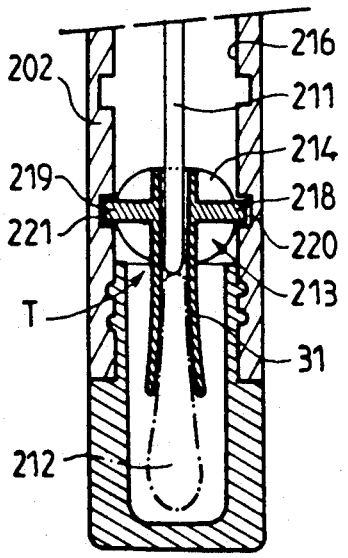
FIG. 6 is a partial axial vertical section of another variant embodiment of the means for connecting the rod carrying the applicator element and the screw.

FIG. 6 shows another variant embodiment of the connection means T for the rod 211 and the screw 213. Those elements of FIG. 6 identical to or playing analogous roles to those of the elements already described with reference to FIGS. 1 to 4 have been designated by reference numerals equal to the sum of the number 200 and the reference numeral used in FIGS. 1 to 4. These elements will not be described again or will only be described briefly.

As can be seen in FIG. 6, the brush 212 is cut in the shape of a bud, i.e. its lower part has a bulging rounded shape, the bristles in this zone having a length greater than that of the bristles situated towards the upper end. The upward reduction in the diameter of the brush is a gradual reduction.

The screw 213 is extended towards the bottom by a truncated cone 31 which covers the upper truncated portion of the brush 212.

When the rod 211 is extracted from the container 202, the upper part of the brush 212 comes into contact with the inner surface of the truncated cone 31 and moves the screw 213 in translation. The cooperation of the projections 218, 219 with the helical grooves 220, 221 results in the simultaneous rotation of the screw 213, the cone 31, as it rotates about the axis of the rod 211, sliding against the ends of the bristles of the brush 212 without being attached thereto.

When the screw 213 reaches the upper ends of the grooves 220, 221, it is locked in rotation and the brush 212 is extracted from the container 202 passing through the truncated cone 31 and the screw 213, the bristles of the brush giving way to allow for this passage.

When the brush 212 is reinserted, it traverses the screw 213 and the cone 31, so that after insertion it is located once again in the position illustrated in FIG. 6.

Figure 7:
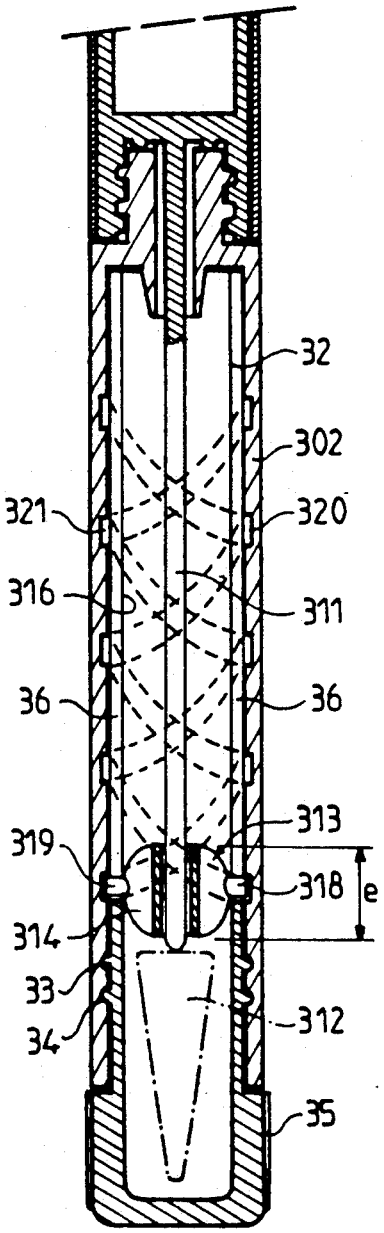
FIG. 7 is an axial vertical section of a variant embodiment.
Figure 8:
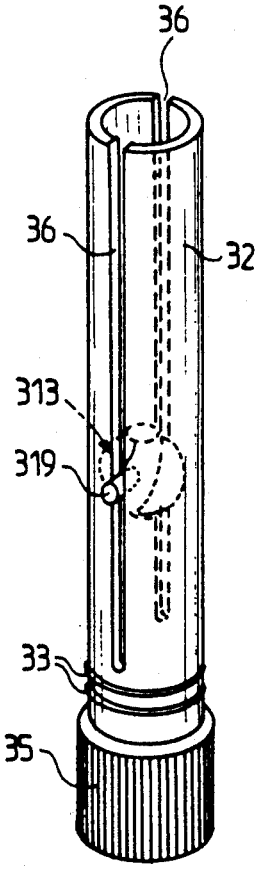
FIG. 8 is a perspective view of the sleeve of the applicator assembly of FIG. 7.

Referring to FIGS. 7 and 8, they show a variant embodiment of the applicator assembly, a variant in which those elements identical to or playing similar roles to the elements already described with reference to FIGS. 1 to 4 have been designated by reference numerals equal to the sum of the number 300 and the reference numeral used in these FIGS. 1 to 4. These elements will not be described again or will only be described briefly.

According to the variant of FIGS. 7 and 8, a sleeve 32 is provided in the interior of the container 302. This sleeve extends from the lower end to the vicinity of the upper end of the container 302, in which it is mounted in such a way that it can rotate about the axis, while being connected in translation to the container 302, e.g. by the snap engagement of circular flanges 33 in corresponding throats 34 provided in the inner wall of the container 302. The sleeve 32 is integral in its lower part with a wheel 35 which closes the end of the sleeve and which is situated axially above the end of the container 302 so that it is accessible from the exterior. The wheel 35 comprises raised areas on its outer cylindrical surface, e.g. rectilinear ribs directed along the generatrices to facilitate the gripping thereof.

The sleeve 32 comprises two diametrically opposing parallel rectilinear sliding surfaces 36 consisting of rectangular slots directed along the generatrices of the sleeve, closed at their lower ends and opening into the upper end of the sleeve 32 as can be seen in FIG. 8.

The sliding surfaces 36 are traversed by the diametrically opposing projections 318, 319, the outer radial ends of these projections being engaged in the helical grooves 320, 321 offset by 180°. The screw 313 is traversed freely by the rod 311, the section of which can be elliptical. The screw 313 can thus rotate and slide relative to the rod 311. The inner wall 316 of the container is formed by the inner wall of the sleeve 32.

In order to stir the product contained in the container 302 while this container is closed and the rod 311 and the brush 312 are located in the interior of this container, the user simply has to rotate the wheel 35 in the appropriate direction to cause rotation of the sleeve 32. The latter drives the screw 313 by the cooperation of the edges of the sliding surfaces 36 and the projections 318, 319. As a result of the fact that these projections also cooperate with the helical grooves 320, 321, the screw 313 is displaced upwards, rotating and thus effecting stirring and shearing of the product, in particular also breaking the thixotropy. When the screw reaches the upper ends of the grooves, the rotation of the wheel 35 is blocked for the direction in question. The user can then lower the screw 313 again by rotating the wheel 35 in the opposite direction. The operation can be repeated several times before use of the product to achieve good homogenisation.

Figure 9:
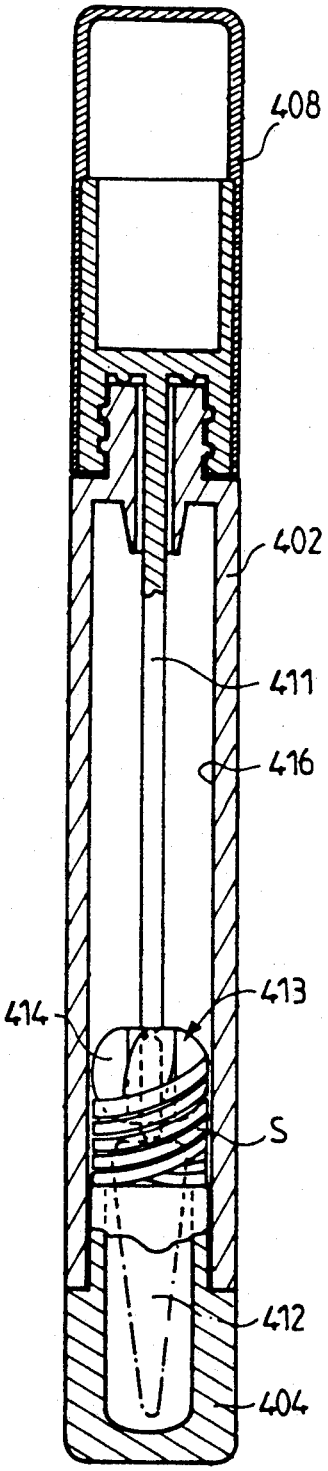
FIG. 9 is an axial vertical section of another embodiment, while the cap is being fixed to the neck.
Figure 10:
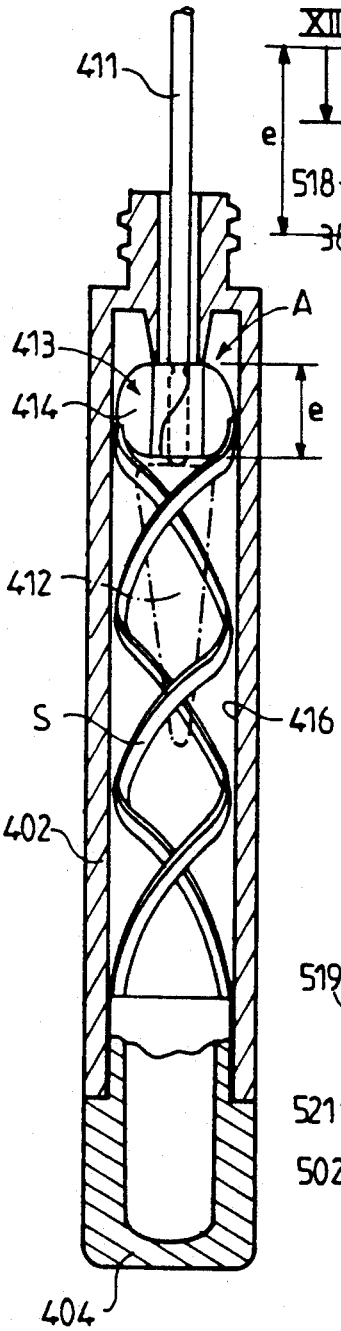
FIG. 10 shows the assembly of FIG. 9 when the applicator element is about to be withdrawn from the container.

Referring to FIGS. 9 and 10, they show another embodiment of the applicator assembly according to the invention. Those elements similar to the elements already described with reference to FIGS. 1 to 4 have been designated by reference numerals equal to the sum of the number 400 and the reference numeral used previously. They will not be described again or will only be described briefly.

The screw 413 is integral with the upper end of an elastic spring or spiral member S of plastic, generally comprising at least two ribs. The base of these ribs is situated in the vicinity of the bottom 404 of the container and is fixed to this bottom which may be attached to the cylindrical body of the container 402.

The screw 413, or more generally the stirring element, is traversed freely in rotation by the rod 411, but is connected in translation to this rod by means similar to the means T described hereinbefore. The translational connection between the screw 413 and the rod 411 is effected in the vicinity of the end of the rod close to the brush 412. In this manner, when the cap 408 is fixed to the container 402, the elastic spiral member S is compressed, as illustrated in FIG. 9.

When the cap 408 is removed, and together with it the rod 411, the screw 413, which forms a sort of plate at the upper end of the spiral member S; is driven in translation by the rod 411 and the brush 412 along the axis of the container 402.

The elastic spiral member S expands in the manner illustrated in FIG. 10 and causes, at the same time as the movement of translation of the screw 413, a movement of rotation about the axis of the container 402. When the screw 413 reaches the upper end of the container 402, it is locked in translation and the brush 412 is withdrawn from the container 402 alone, passing through the central opening of the screw 413.

The screw 413 forming a plate and the spiral spring S are advantageously formed in one single piece moulded from plastic material.

Figure 11:
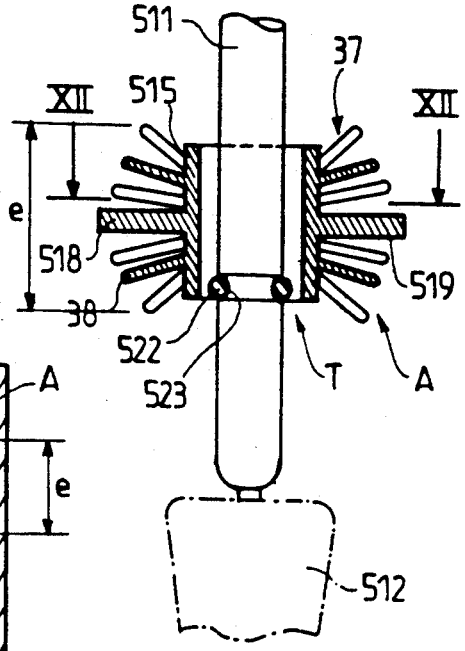
FIG. 11 is a detail, in part section, of an embodiment in which the stirring element consists of a sprocket wheel and, finally.
Figure 12:
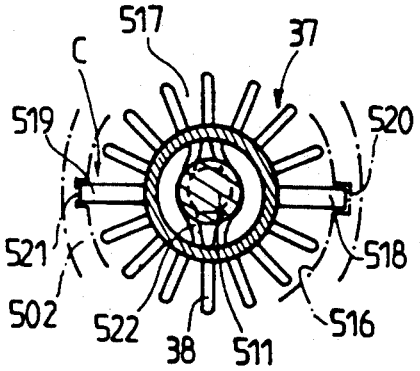
FIG. 12 is a simplified section along the line XII—XII of FIG. 11.

Referring to FIGS. 11 and 12, they show a variant embodiment in which the stirring element A consists not of a screw as in the case of the preceding embodiments, but of a sort of sprocket wheel 37. Those elements of FIGS. 11 and 12 similar to the elements already described with reference to FIGS. 1 to 4 have been designated by reference numerals equal to the sum of the number 500 and the reference numeral used previously, these elements not being described again.

The sprocket wheel 37 is formed by ribs 38 having sufficient rigidity to mix the product contained in the container, these ribs 38 extending radially from a sleeve 515 forming a boss to the inner wall 516 (FIG. 12) of the container 502.

The sleeve 515 is provided in its lower part with lugs 522 each provided with a sort of nose adapted to enter into snap engagement with a throat 523 provided on the rod 511. The lugs 522 are advantageously formed by two flexible walls, as can be seen in FIG. 12, adapted to move away from one another in order to form a sort of oval passage in order to receive between them the throat 523.

The operation of the applicator assembly of FIGS. 11 and 12 will be immediately clear from the preceding description.

At the time of use, when the cap is removed from the container and the rod 511 is extracted, the cooperation of the projections 518, 519 with the mating helical grooves results in rotation of the sprocket wheel 37 at the same time as its displacement in translation.

The ribs of the sprocket wheel 38 act like the blades of the screw and ensure homogenisation of the product and the breakage of its thixotropy.

I claim:

1. An applicator assembly comprising a container for a pasty cosmetic product having a heterogenous or thixotropic composition, said container having lateral wall, at one end of said lateral wall a neck and a bottom at an opposite end of said lateral wall, said neck having a drainage lip, a cap having means for fixing said cap on said neck and carrying a rod, said rod having an end remote from said cap, said end having an applicator element, said rod having a length so that said applicator element is disposed adjacent said bottom when said cap is mounted on said neck of said container, a stirring element rotatably mounted in said container, said container having driving means for rotatably driving said stirring element upon movement of said rod out of said container, said stirring element having extensions extending radially from said rod toward said lateral wall when said rod is in said container, said extensions defining axial passages between adjacent said extensions, said assembly further including control means for moving said stirring element along said lateral wall with said rod while permitting rotation of said stirring element, said stirring element having at least two oppositely extending radial projections, said driving means comprising two helical grooves on said lateral wall each receiving a said projection.

2. An applicator assembly comprising a container for a pasty cosmetic product having a heterogenous or thixotropic composition, said container having lateral wall, at one end of said lateral wall a neck and a bottom at an opposite end of said lateral wall, said neck having a drainage lip, a cap having means for fixing said cap on said neck and carrying a rod, said rod having an end remote from said cap, said end having an applicator element, said rod having a length so that said applicator element is disposed adjacent said bottom when said cap is mounted on said neck of said container, a stirring element rotatably mounted in said container, said container having driving means for rotatably driving said stirring element upon movement of said rod out of said container, said stirring element having extensions extending radially from said rod toward said lateral wall when said rod is in said container, said extensions defining axial passages between adjacent said extensions, said assembly further including control means for moving said stirring element with said rod while permitting rotation of said stirring element, said driving means comprising an elastic spiral member having at least two ribs each having a first end fixed adjacent said bottom of said container and a second end fixed to said stirring element so that, upon movement of said rod out of said container, said spiral member will rotate said stirring element about said rod, said control means allowing separation of said rod from said stirring element adjacent said lip.

3. Applicator assembly as claimed in claims 1 or 2, wherein said container has a selected length along a longitudinal axis and the dimensions of said stirring element in the direction of said longitudinal axis in less than one quarter of the length of said container.

4. The applicator as claimed in claims 1 or 2, wherein said stirring element comprises a screw member having radially extending blades defining said extensions.

5. The applicator assembly as claimed in claims 1 or 2, wherein said stirring element comprises a sprocket wheel having said extensions in the form of ribs extending from a sleeve of said sprocket wheel.

6. The applicator assembly as claimed in claim 1 wherein said control means includes means releasably engaging said rod so that when said rod is removed from said container, said means releasably engaging releases said rod and reengages said rod when said rod is inserted into said container.

7. The applicator assembly as claimed in claim 6 wherein said stirring element includes a boss and said means releasably engaging comprise lug means on said boss, said rod having an elastic sleeve adjacent said applicator element and surrounding a reduced radial portion of said rod, said lug means gripping said elastic sleeve portion of said rod and moving a portion of said sleeve radially inwardly and, upon release of said rod, said sleeve expanding to allow drainage of said sleeve.

8. The applicator assembly as claimed in claim 1 wherein said container has a longitudinal axis and said control means comprises a sleeve member mounted for rotation in said container and extending along said lateral wall, said sleeve member having one end connected to a drive wheel located at one end of said container remote from said neck, said sleeve member including rectilinear sliding surfaces extending parallel to said axis of said container and of a size to receive a said radial projection so that, upon rotation of said drive wheel, said stirring element will be moved along said lateral wall while rotating about said longitudinal axis, said rod being disposed to extend through said stirring element with said stirring element being freely rotatable about said rod and movable therealong.

* * * * *